United States Patent [19]

Matsumoto

[11] Patent Number: 4,522,123

[45] Date of Patent: Jun. 11, 1985

[54] PINHOLE REMOVAL DEVICE IN PRINTING

[75] Inventor: Katsutoshi Matsumoto, Kyoto, Japan

[73] Assignee: Dainippon Screen Mfg. Co., Ltd., Kamikyo, Japan

[21] Appl. No.: 504,523

[22] Filed: Jun. 15, 1983

[30] Foreign Application Priority Data

Jul. 6, 1982 [JP] Japan ..... 57-118199

[51] Int. Cl.[3] ..... B41F 31/00

[52] U.S. Cl. ..... 101/349; 118/262

[58] Field of Search ..... 101/348, 349, 350, 351, 101/352, 136, 148, 207, 208, 210; 118/262

[56] References Cited

U.S. PATENT DOCUMENTS

| | | | |
|---|---|---|---|
| 2,888,902 | 6/1959 | Wells et al. | 118/262 X |
| 2,894,452 | 7/1959 | Trisler | 101/136 |
| 4,233,898 | 11/1980 | Dahlgren | 101/351 X |
| 4,325,995 | 4/1982 | Tamura et al. | 101/350 X |
| 4,400,418 | 8/1983 | Takeda et al. | 101/148 X |

FOREIGN PATENT DOCUMENTS

| | | |
|---|---|---|
| 624846 | 1/1936 | Fed. Rep. of Germany . |
| 2321319 | 11/1974 | Fed. Rep. of Germany . |
| 480122 | 2/1938 | United Kingdom . |

*Primary Examiner*—Edgar S. Burr
*Assistant Examiner*—Moshe I. Cohen
*Attorney, Agent, or Firm*—Brumbaugh, Graves, Donohue & Raymond

[57] ABSTRACT

There is provided a device for removing pinholes produced in printing comprising a levelling roller provided in contact with a form plate and/or a peripheral surface of a blanket cylinder so that an ink film transferred to the plate and/or the peripheral surface of the blanket cylinder may be levelled or smoothed before the ink film contacts a printing object. There is also provided a device for removing pinholes comprising a levelling roller of which peripheral surface is an oil-repellent layer.

1 Claim, 2 Drawing Figures

PINHOLE REMOVAL DEVICE IN PRINTING

BACKGROUND AND SUMMARY OF THE INVENTION

The present invention relates to a pinhole removal device, more particularly to a device for removing pinholes produced in printing by lithographic press, intaglio press or the like.

When a nonabsorptive printing object such as a metallic plate, plastic plate, glass plate, etc. is printed by a lithographic press, intaglio press or the like, it is often the case that numerous pinholes are produced within a layer of ink, since numerous micro-bubbles are confined within the layer of ink of a form portion and the layer of ink is dried with the said micro-bubbles therein.

A serious problem exists in that pinholes within the layer of ink not only negatively affect the thickness of the printed surface of a name plate or the like, but, particularly in case of a printed board, anti-corrosion of the ink film which forms a printed circuit is decreased by such pinholes.

FIG. 1 is a typical illustration to exaggeratively show what is called the "cavitation theory" with respect to the formation of pinholes, wherein the ink film 12 of a form roller 11 is just transferred to the form portion of the form plate 14 mounted on a plate cylinder 13.

When the form roller 11 and the plate cylinder 13 contact each other and pass over the point A which is in contact with the form plate 14 by the rotation in the direction of the arrows at the same peripheral velocity respectively, as shown in FIG. 1, the pressure within the ink film 12 of the form roller 11 is rapidly increased and the first area without shear appears at the point B where the said pressure is maximized. On and after passing the contact portion between A and D (point C shows the center thereof), the said pressure is equal to the air pressure (gauge pressure stands zero), and the area is again without shear. After passing the said area, the pressure within the ink film 12 is reduced to a minimun below the air pressure, and then returns to the air pressure. Nearby the minimum point of the said pressure, a micro-hole is produced by the upward and downward tensions on the ink film 12. The said micro-hole grows up to a cavity and splits like cobwebbing, finally being transferred to the form portion of the form plate 14.

The layer of ink 12' thus split and transferred to the form portion of the form plate presents a rough surface composed of irregularity in the shape of micro-craters. The ink film 12' transferred to the form portion of the form plate 14 is to be levelled or smoothed by the surface tension with the lapse of time. However, the time it takes for the form portion of the form plate 14 to contact the printing object is so short that the said levelling does not sufficiently progress. Consequently, when the form portion contacts the smooth surface of the printing object, the air within the said micro-craters is still confined in the layer of ink to be transferred to the printing object, growing up to bubbles and finally forming pinholes. This is an outline of the cavitation theory with respect to the formation of pinholes.

It is understood by the said description that when printing object is a metallic plate or glass plate having no permeability, pinholes are easily produced in comparison with those having permeability like paper.

In order to reduce such pinholes, several attempts have been proposed such as a method for crushing and discharging bubbles confined within the layer of ink by increasing the printing pressure or by decreasing the printing speed, or a method for increasing the levelling effect of the ink film by employing some soft ink. However, any of those conventional methods has a fatal disadvantage that although they succeed in decreasing or reducing pinholes, the print contrast ratio or visibility of the printed image is inevitably reduced to a certain extent. Therefore, the said conventional methods are not the preferred means for removing pinholes.

It is, therefore, an object of the present invention to provide a pinhole removal device to solve the above-discussed problems and disadvantages inherent to printing by a lithographic press, intaglio press or the like by providing a levelling roller in contact with the form plate and/or the peripheral surface of a blanket cylinder before reaching the printing position, so that cratering or micro-craters on the ink film may be levelled or removed by the said levelling roller. More particularly the present invention contemplates a device for removing pinholes, wherein cratering or micro-craters on the ink film into which the air is taken to be confined in the form of bubbles within the layer of ink which is formed by transferring the said ink film of the form portion to the printing object from the form plate and/or the peripheral surface of the blanket cylinder, causing the formation of pinholes when the ink is dried and set, can be removed by the said levelling roller, thereby printing is successfully carried out without producing pinholes nor negatively affecting the print contrast ratio of the printed image.

Other objects, features and advantages of the present invention will become apparent in the course of the following description with the accompaning drawings.

BRIEF DESCRIPTION OF THE DRAWINGS

In the drawings, forming a part of the present application, and in which like parts are designated by the reference numerals throughout the same.

DESCRIPTION OF THE PREFERRED EMBODIMENTS

Figure 2:
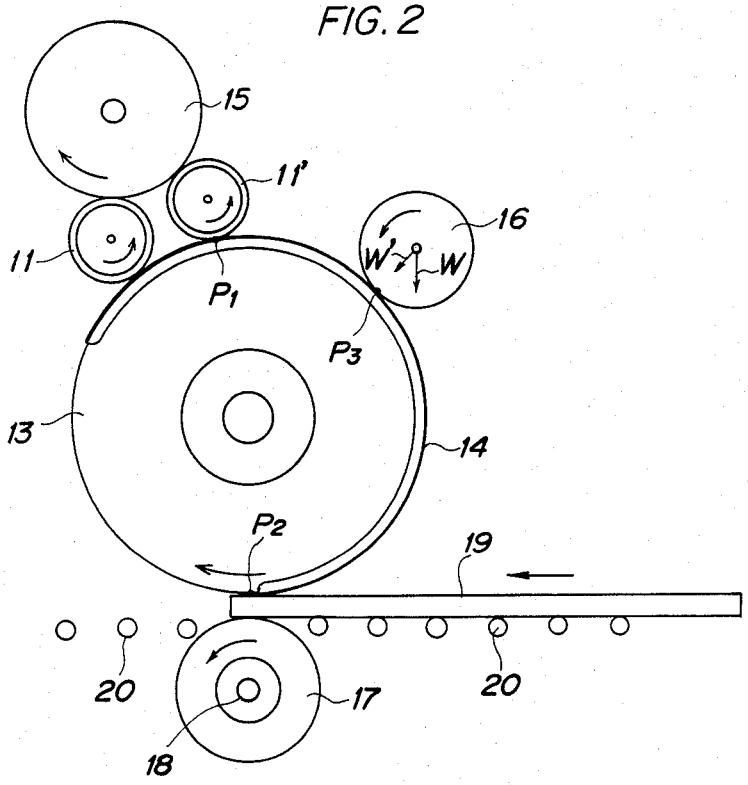
FIG. 2 is a typical illustration of the substantial part of an preferred embodiment according to the present invention.

Referring now to the drawings, FIG. 2 is a typical illustration, wherein a substantial part of an embodiment according to the present invention is shown with respect to the thick printing on the nonabsorptive printing object such as metallic plate, plastic plate or the like by means of intaglio without any damping system.

The form plate or the intaglio 14 mounted on the plate cylinder 13 comprises a form portion having lipophilic property by removing the oil-repellent film therefrom in accordance with the pattern of the original print, and a non-form portion retaining the oil-repellent film thereon. The form rollers 11, 11' with rubber lining on the peripheral surface thereof are provided in contact with the plate cylinder 13 so that the said rollers may feed the said form portion of the intaglio 14 with ink. The said rollers 11, 11' are provided with an intermediate roller 15 of metal so as to be in contact therewith. The levelling roller 16 being in contact with the plate cylinder 13 is provided in the position between the final forming point P1 and the printing point P2 of the plate cylinder 13, preferrably slightly near to the form roller 11'. Each of these rollers 11, 11', 15, 16 rotates in the direction of the arrows shown in the illustration at the same peripheral speed on their contact surfaces respectively, by the friction drive by the contact with the peripheral surface of the plate cylinder 13 on which the intaglio 14 is mounted, or by such other drive as gear transmission. The intermediate roller 15 is fed with ink through the roller train from an ink fountain device (not illustrated). The levelling roller 16 whose peripheral surface has a lining of the oil-repellent layer such as silicone rubber is mounted on the frame so that the bearing (not illustrated) for supporting the rotating shaft may slide in the vertical direction. The impression cylinder 17 is pivoted on the supporting shaft by the known means, and rotates in the direction of the arrow at the same peripheral speed as the intaglio 14 by a driving shaft (not illustrated) having a pinion mating with a driven gear fixed to the side plate of the plate cylinder.

FIG. 2 illustrates a printing object 19 such as plastic board being delivered between the plate cylinder 13 and the impression cylinder 17 which is in the state of impression throw off, the cylinder 17 being put into the state of impression throw in after the end of the said printing object 19 has passed the printing point P2.

Figure 1:
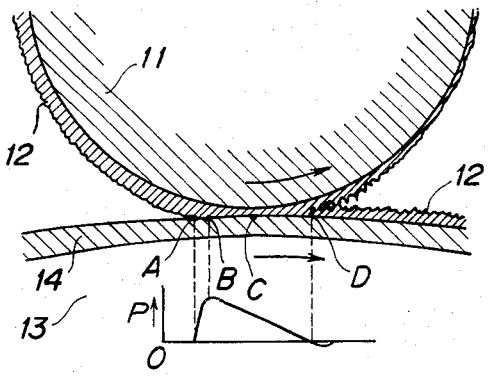
FIG. 1 is a typical illustration exaggeratively showing an ink film of the form roller being transferred to the form portion of the form plate mounted on the plate cylinder.

Referring now to the operation of this embodiment according to the present invention, the ink film which is transferred to the form portion of the intaglio 14 through the form rollers 11, 11' presents almost the same rough surface as ink film 12' as described referring to FIG. 1, so long as the ink film is situated in the surface of a circular arc between the final forming point P1 and the point P3 which contacts the levelling roller 16. When the ink film passes the levelling roller 16, a moderate pressure W' is given to the said ink film in the direction of the normal line by the component of force of the dead weight of the levelling roller 16 from the smooth peripheral surface thereof having the oil repellent property, and the said rough surface is levelled to be a smooth surface. The said pressure can be also given by such other means as spring.

Consequently, at the printing position P2, the cratering or micro-craters of the rough surface, in which the air is taken inevitably causing a formation of pinholes when the ink is dried and set since the air is confined in the form of bubbles within the layer of ink to be transferred to the plastic board 19 from the form portion of the intaglio 14, can be perfectly levelled and removed by the levelling roller 16, thereby printing without pinholes can be carried out.

Although the foregoing description is illustratively referred to the direct printing method in which printing is carried out by bringing the intaglio 14 into contact with the printing object 19, also in case of mounting a form plate for the lithographic press in place of the intaglio, printing without pinholes can be achieved by providing the very same device.

In case of the indirect printing such as offset press wherein a blanket cylinder or a rubber cylinder is interposed between the plate cylinder and the printing object, the advantages according to the present invention are maximized by providing the levelling roller 16 so as to be in contact with the said blanket cylinder before reaching the printing position. The similar advantages are gained by providing the said levelling roller 16 so as to be in contact with the form plate on the plate cylinder already formed by the form roller, before bringing the said form plate into contact with the blanket cylinder. Further it is also preferred to provide both the form plate already formed and the blanket cylinder with their levelling rollers 16 at the said location respectively.

With respect to the embodiment illustrated in FIG. 2, as the ink film transferred to the form portion of the form plate or intaglio 14 is pressed by the levelling roller 16 so that the rough surface of the ink film may be smoothed, it may be concerned that the form portion grows bold negatively affecting the print contrast ratio or visibility of the printed image. However, in case of the said intaglio without any damping system, since the ink film of the form portion is adjacent to the oil-repellent part which forms the non-form portion, the growing boldness of the form portion of the intaglio 14 is contracted and restored by the surface tension of the ink itself before reaching the printing point P2. Thus the boldness initially caused by the levelling roller 16 does not affect the printed image.

In case of the offset press, the form portion may grow slightly bold, however, this is easily compensated by making the form portion light-faced beforehand, if necessary.

It will be evident to those skilled in the art that the present invention is not limited to the details of the foregoing illustrative embodiments, and that the present invention may be embodied in other specific forms without departing from the essential attributes thereof, and it is therefore desired that the foregoing embodiments be considered in all respects as illustrative and not restrictive, reference being made to the appended claims, rather than to the foregoing description, and all changes which come with the meaning and range of equivalency of the claims are therefore intended to be embraced therein.

What is claimed is:

1. In printing apparatus having a rotary printing member, inking means contacting said printing member to create on said printing member an ink film to be transferred to an object to be printed, a device for preventing pinholes from forming in the ink transferred to the object comprising a leveling roller having an oil-repellant surface disposed in rolling contact with the ink film carried by the printing member, said leveling roller being mounted on an axis which is movable with respect to the axis of said rotary printing member, said leveling roller being effective to level the film of ink before it is transferred to the object.

* * * * *